United States Patent [19]

Kufrin

[11] 4,426,781

[45] Jan. 24, 1984

[54] CUTTER FOR MAKING PAPER DISCS

[75] Inventor: Fred Kufrin, Janesville, Wis.

[73] Assignee: Badge A. Minit Ltd., LaSalle, Ill.

[21] Appl. No.: 382,625

[22] Filed: May 27, 1982

[51] Int. Cl.[3] ..... B26B 27/00

[52] U.S. Cl. ..... 30/310; 30/289

[58] Field of Search ..... 30/310, 321, 300, 293, 30/289; 128/305, 310; 83/490

[56] References Cited

U.S. PATENT DOCUMENTS

| | | | |
|---|---|---|---|
| 2,066,381 | 1/1937 | Albertson | 83/490 |
| 2,230,400 | 2/1941 | Cadirola | 83/490 |
| 3,621,574 | 11/1971 | Yanke | 30/310 X |
| 4,144,641 | 3/1979 | Akselrad | 30/289 |
| 4,173,913 | 11/1979 | Nicholson | 30/310 X |
| 4,205,682 | 6/1980 | Crock | 30/293 X |

FOREIGN PATENT DOCUMENTS

| | | | |
|---|---|---|---|
| 2043519 | 10/1980 | United Kingdom | 30/310 |

*Primary Examiner*—Jimmy C. Peters

*Attorney, Agent, or Firm*—Wm. A. Snow

[57] ABSTRACT

A device for cutting discs of paper of either a diameter of $2\frac{1}{4}''$ to $2\frac{3}{4}''$ with means to adjust the depth of the cutter blade all contained in a circular, stationary container and incorporating means to rotate the cutter blade.

8 Claims, 10 Drawing Figures

FIG-5
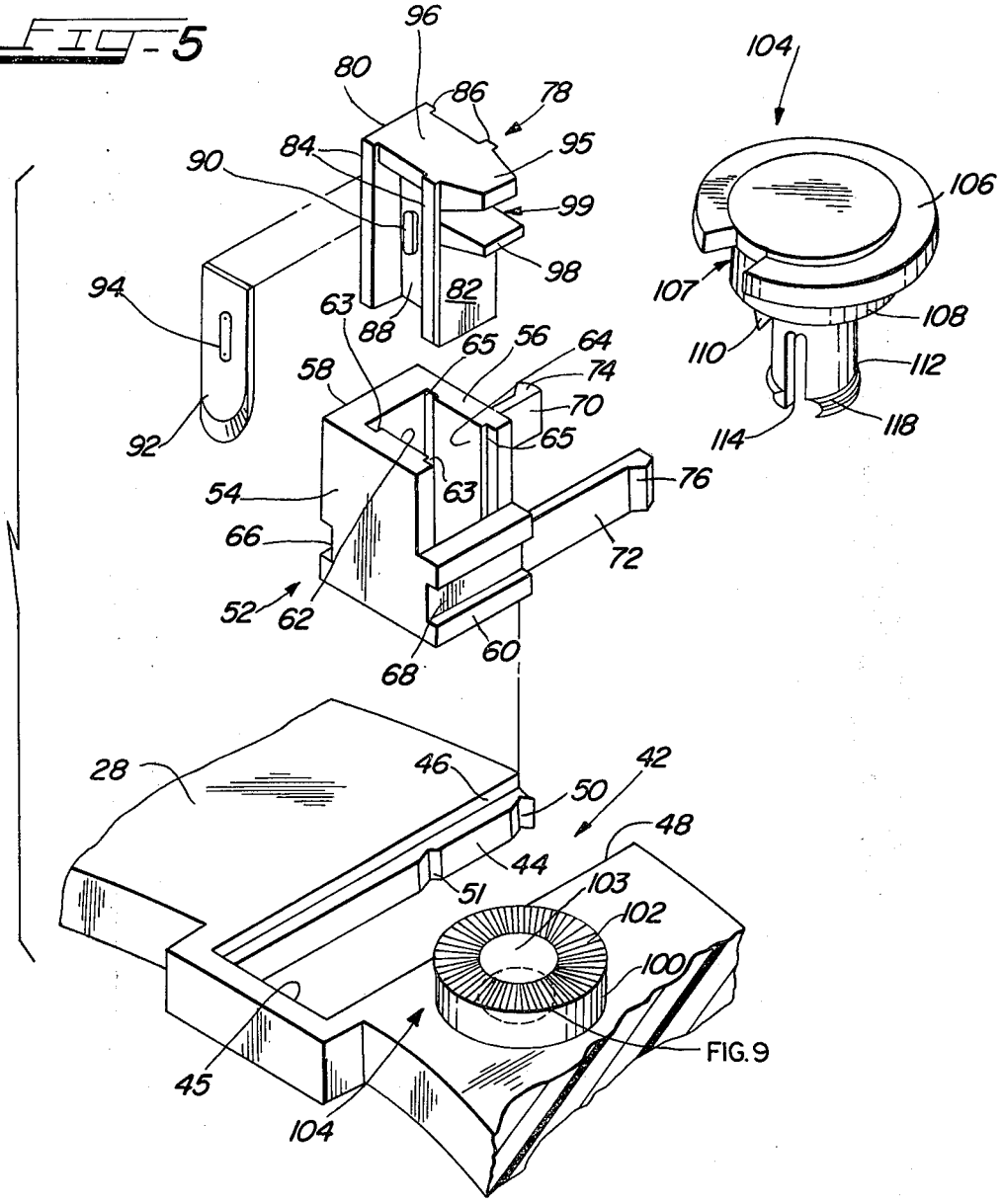
FIG. 9
FIG-9
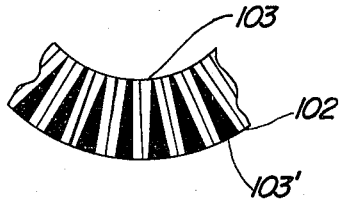

CUTTER FOR MAKING PAPER DISCS

SUMMARY OF THE INVENTION

A disc cutter capable of cutting two different size discs having an outer housing and an inner rotary housing carrying the cutter blade and means to adjust the cutter blade carried by the inner housing to various depths, all made of plastic except the cutter blade.

BRIEF DESCRIPTION OF THE DRAWINGS

FIG. 5 is an expanded view in perspective of the assembly of the cutter blade adjustable feature, the cutter blade and the adjustable block, with parts broken away;

FIG. 9 is a top plan view taken in the circle of FIG. 5.

DETAILED DESCRIPTION OF THE DRAWINGS

Figure 2:
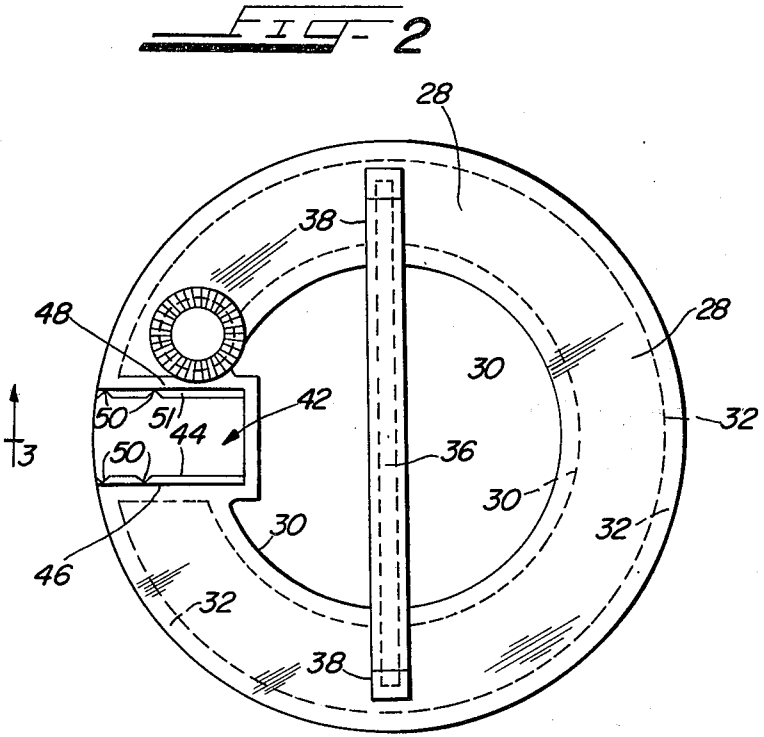
FIG. 2 is a top plan view of the inner housing.

The outer housing 10 of this invention is in the form of a flat ring and of elongated, inverted, U-shape like in cross-section having a side wall 12 which tapers upwardly inwardly as at 14 and then horizontally as at 16. An annular groove 18 is positioned adjacent the lower inner wall 12 to act as a seat for the annular detent 20 on the side wall of the bottom wall 22 which is in the form of a disc to snap lock the bottom wall thereto. An enlarged, circular medial opening 24 is formed in the bottom wall.

The inner housing is a flat ring 28 having spaced, downwardly projecting, semi-circular walls 30, 32, the lower end of wall 32 being rotatable on the inner surface of bottom wall 22 while the upper surface 29 between the walls 30, 32 slightly abuts the inner surface of the wall 16 whereby the inner ring is rotatable in the outer housing. A handle manipulating bar 36, of inverted, U-shape like in cross-section, is anchored in the openings 38 adjacent the upper surface of ring 28 and in the area 40 to rotate the inner ring 28 in the outer ring housing.

Figure 1:
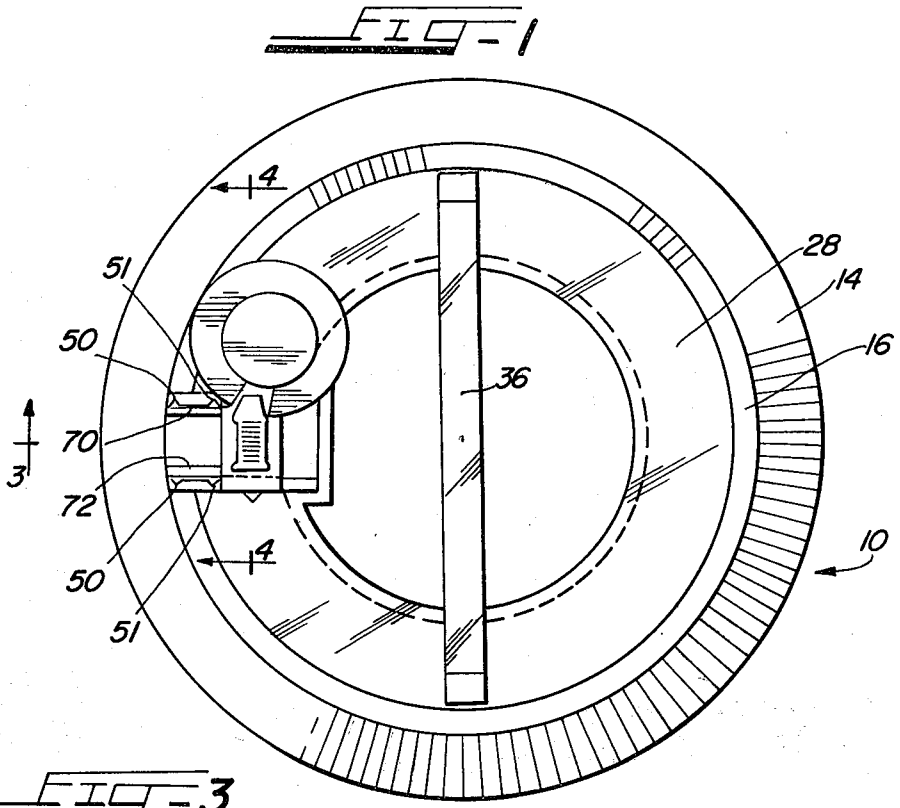
FIG. 1 is a top plan view of the device of the present invention fully assembled.
Figure 4:
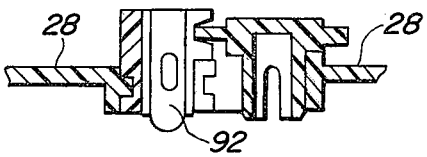
FIG. 4 is a cross-sectional view taken on the line 4—4 of FIG. 1.
Figure 3A:
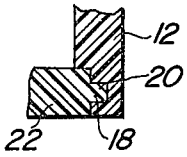
FIG. 3A is an enlarged view taken in the circle 3A of FIG. 3.
Figure 3:
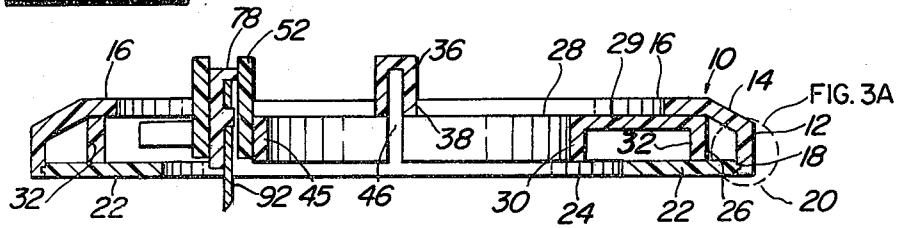
FIG. 3 is a cross-sectional view taken on the line 3—3 of FIG. 2.
Figure 8:
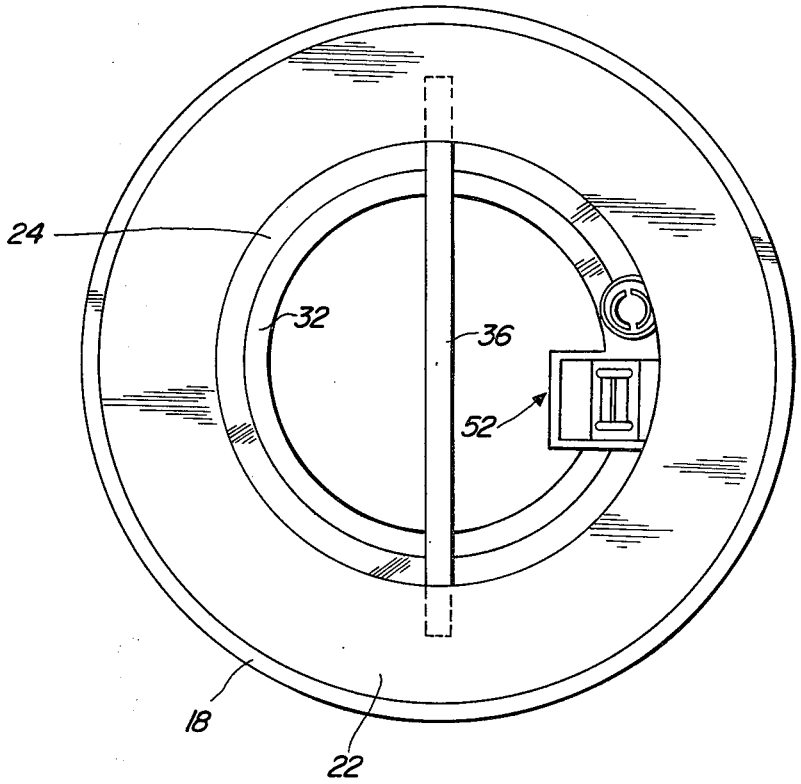
FIG. 8 is a bottom plan view of FIG. 1.
Figure 6:
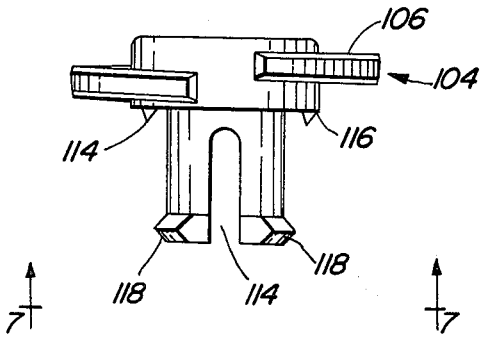
FIG. 6 is a side view of the cam adjustment feature for raising and lowering the blade.

A horizontally extending, U-shaped, rectangular opening 42 is provided in the ring 28 having inwardly extending, narrow ribs 44 on each of the side walls 46, 48 medially of the upper and lower ends of said side walls. Each rib 44 contains pairs of spaced "V" recesses 50, 51, the purpose of which will hereinafter be made clear. The walls 46, 48 and rear wall 45 forming the opening 42 are the same thickness as the inner ring 28. See FIGS. 1, 2 and 6.

An adjustment block 52 (see FIG. 5) is generally of U-shape in horizontal cross-section and contains side walls 54, 56 and a full end wall 58 and a shortened end wall 60. The inner surfaces of side walls 54, 56 are provided with inwardly extending wide ribs 62, 64 to form vertically extending pairs of grooves 63, 65. The lower ends of the end walls are each provided with longitudinally extending grooves 66, 68 in which the ribs 44 movably seat for movement forwardly or rearwardly.

A pair of semi-resilient fingers 70, 72 are anchored to the outer side end wall 56 and extending outwardly thereof adjacent the lower end thereof and terminate in outwardly extending, V-shaped lugs 74, 76 which are arranged to snap seat in either of the V-shaped recesses 50, 51 in the ribs 44 upon movement fore and aft of the adjustment block 52.

The blade holder 78 is elongated and has end walls 80, 82 and a relatively thick medial wall 88. Pairs of spaced ribs 84, 86 extend outwardly of the inner surfaces of the end walls 80, 82. The wall 88 is provided with a bulbous shaped protrusion 90. An elongated, flat blade 92 is provided with an opening 94 similar to the protrusion 90 for seating therearound and the blade is heat staked permanently to the wall 88. The sharpened end of the blade will extend below the wall 88 and the inner ring 28. The blade holder slides up and down in the adjustment block with ribs 84, 86 seated in the grooves 63, 65.

The blade holder is also provided with a top wall 96 having a portion 95 which extends outwardly of the end wall 82, the side edges of which are partially tapered. A protruding, horizontally extending, short wall 98 is anchored at one end to the wall 82 and is provided with partially tapered side walls. The wall 98 is spaced below the extension 95 to form a groove 99. The inner opposed walls of members 95, 98 are tapered reardly from front edge to their walls.

The upper surface of the top wall 28 adjacent the wall 48 of the rectangularly shaped opening 42 is provided with a short, cylindrical member 100, the top surface of which is provided with V-shaped indexing teeth 102, the grooves 103' between the teeth being thirty-six in number and ten degrees apart. An axial opening 103 is provided therein.

Figure 7:
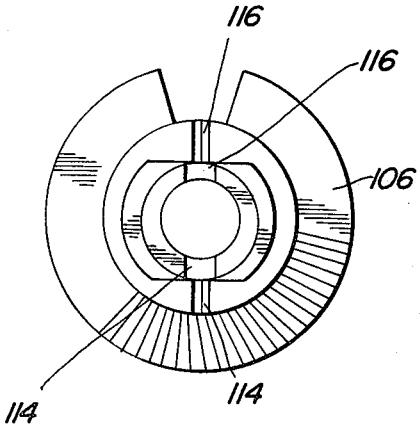
FIG. 7 is a plan view taken on the line 7—7 of FIG. 6.

The blade adjusting member 104 is provided with peripheral tapered cam surfaces 106 and having an opening 107. Integrally formed axially below the cam surface is a short, cylindrical portion 108 having a pair of opposed V-shaped lugs 110 on its lower surface which seat in the index teeth 102. An elongated, cylindrical collet 112 integrally formed axially on the short tube 108 extends downwardly therefrom and is of a diameter to readily seat in the elongated opening 103. The wall of the collet 112 is provided with opposed clefts 114, 116. (See FIG. 7.) The lower end of collet 112 is provided with outwardly extending, V-shaped member 118 whereby when the blade adjusting member 104 is slid in the opening 103, the side wall of the collet will tend to close the clefts so the member 118 may be trapped below the bottom wall of the inner ring 28. Therefore the lugs 110 will be seated in the indexing teeth 102. Also, because of the opening 107, the groove 99 will be in position to receive the periphery of the cam 106. (See FIG. 1.)

Upon rotation of the blade adjusting member 104, the lugs 110 will move up the sides of the indexing teeth and fall in the grooves 103'. As this takes place, a click will be audible because the V-shaped wall of member 118 will partially shift upwardly and downwardly. This movement will cause the blade holder 78 to shift upwardly or downwardly by movement of the cam 106 seated in the groove 99. Each click will move the blade 0.002" so that if a thick sheet of paper or several sheets of paper are positioned on a board to cut circles, the blade would be moved down to its lowest position, i.e., on the lowest portion of the cam.

If only one sheet of thin paper is cut to produce a disc, the blade may be moved upwardly by shifting the cam to about the highest point of the cam.

This device is designed to cut either 2¼" disc or a 2¾" disc. By pushing the end wall 54 of the adjustment block outwardly, the fingers 70, 72 will shift from their recesses 51 to seat in the recesses 50 in the ribs 44 whereby a 2¾" disc may be cut. By forcing the wall 56 rearwardly against the wall 45, the fingers 70, 72 will shift the lugs 74, 76 out of the recesses 50 and seat in the recesses 51, whereby a 2¼" disc may be cut.

The outer surface of the bottom wall 22 has a matte or textured surface to keep the unit from slipping on the paper while the cut is made.

In operation, if a 2¼" disc is to be cut, the walls 45 and 54 should abut each other. The blade holder is adjusted by rotating the cam surface to adjust the blade 92 according to the thickness of the paper to be cut. The index finger and thumb of one hand are placed on the tapered surface 14 of the outer ring and pushed downwardly. The other hand is used to rotate the inner ring 28 by use of the handle 36. Thus paper discs will be cut singly or in multiples.

Although but one specific embodiment of this invention is herein shown and described, it will be understood that details of the construction shown may be altered or omitted without departing from the spirit of the invention as defined by the following claims.

I claim:

1. A disc paper cutter comprising an outer stationary ring having upper, lower and side walls, an annular recess in the inner side of said side wall, an inner revolving ring shiftably seated in the periphery in said recess to retain said inner ring in said recess, an adjustable cutter blade on said inner ring for movement both upwardly and downwardly, a short hollow cylindrical member having an upper end integrally formed adjacent the periphery of said inner ring, a series of index teeth on the upper end of said cylindrical member, an axial opening extending through said cylindrical member, an elongated collet having opposed clefts positioned in said axial opening with an annular cam on the upper surface thereof, a pair of opposed, downwardly depending lugs on the lower surface of said cam for engagement with said index teeth for raising and lowering said cutter blade.

2. The device according to claim 1 wherein the lower end of the collet is provided with an outwardly extending, V-like shaped member, the upper surface of which bearing against the bottom wall of the inner ring adjacent said axial opening.

3. The device according to claim 2 wherein said inner ring is provided with an elongated rectangular opening adjacent said short cylindrical member having side walls and an end wall, an adjusting block seating in said rectangular opening, a pair of semi-flexible fingers extending outwardly of said block, pairs of opposed spaced seats in said side walls adjacent the outer ends thereof, said fingers having outwardly extending lugs on the free end of said fingers for seating in a pair of said seats, and said block being shiftable longitudinally whereby said lugs may shift from one or the other pairs of said seats.

4. The device of claim 3 wherein said side walls of said rectangular opening are provided with opposed rails and said block is provided with grooves for seating in said rails.

5. The device according to claim 4 wherein the pairs of seats are positioned in said rails.

6. The device according to claim 5 wherein a blade holder is shiftably seated in said adjusting block for up and down movement.

7. The device according to claim 6 wherein said blade holder is provided with a blade and has side walls, and pairs of rails extending the length of said side walls adjacent the side edges thereof, said adjusting block is hollow and provided with side walls, the inner surface of each side wall having spaced grooves thereon to receive said rails whereby said blade holder will shift upwardly and downwardly.

8. The device according to claim 7 wherein said blade holder is provided with outwardly extending, spaced walls having tapered side walls and the inner face of said walls being slightly tapered from front to back to seat the cam whereby, upon rotation of said cam, said blade holder and blade will shift upwardly and downwardly.

* * * * *